US010413075B1

(12) United States Patent
Robinson

(10) Patent No.: US 10,413,075 B1
(45) Date of Patent: Sep. 17, 2019

(54) SEATS FOR IMPROVING POSTURE AND ALIGNMENT OF THE SPINE AND METHODS OF ACHIEVING THE SAME

(71) Applicant: Sean Robinson, Ridgway, PA (US)

(72) Inventor: Sean Robinson, Ridgway, PA (US)

( * ) Notice: Subject to any disclaimer, the term of this patent is extended or adjusted under 35 U.S.C. 154(b) by 0 days.

(21) Appl. No.: 15/805,712

(22) Filed: Nov. 7, 2017

Related U.S. Application Data

(63) Continuation-in-part of application No. 15/080,884, filed on Mar. 25, 2016, now abandoned.

(60) Provisional application No. 62/420,754, filed on Nov. 11, 2016.

(51) Int. Cl.
*A47C 9/00* (2006.01)

(52) U.S. Cl.
CPC ..... *A47C 9/002* (2013.01)

(58) Field of Classification Search
CPC ..... A47C 9/002; A47C 9/027; A47B 13/003; F16B 12/52; F16B 1/00; F16B 2001/0035
USPC ..... 248/188, 188.1; 297/423.11, 423.12, 297/451.4, 195.11, 271.5
See application file for complete search history.

(56) References Cited

U.S. PATENT DOCUMENTS

| | | | | |
|---|---|---|---|---|
| 731,437 | A * | 6/1903 | Czermak et al. | A45B 5/00 135/66 |
| 970,721 | A * | 9/1910 | Kirkpatrick | |
| 3,306,658 | A * | 2/1967 | Roberts | A47C 7/022 297/4 |
| 4,451,080 | A * | 5/1984 | Nix | A61H 3/00 135/84 |
| 4,526,422 | A * | 7/1985 | Mengshoel | A47C 9/005 105/344 |
| 4,700,914 | A | 10/1987 | Cheetham | |
| 6,062,638 | A | 5/2000 | Ferguson | |
| D446,054 | S | 8/2001 | Jeup | |
| D459,598 | S | 7/2002 | Andersen | |
| 6,997,513 | B2 | 2/2006 | Ige | |
| 7,086,702 | B1 | 8/2006 | Hurt | |
| D648,960 | S | 11/2011 | Starck | |
| 8,465,099 | B2 * | 6/2013 | Addy | A47C 16/04 297/423.11 |
| 8,590,974 | B2 * | 11/2013 | Kalayjian | A47C 16/04 297/423.11 |
| 9,560,911 | B1 * | 2/2017 | Gharabegian | A47B 13/06 |
| 2011/0285188 | A1 * | 11/2011 | Addy | A47C 9/00 297/271.1 |

(Continued)

FOREIGN PATENT DOCUMENTS

| | | | | |
|---|---|---|---|---|
| CA | 2129262 | A1 * | 2/1996 | A45B 5/00 |
| CA | 2200134 | A1 * | 9/1998 | B63B 29/04 |

(Continued)

*Primary Examiner* — Kimberly T Wood

(57) ABSTRACT

Improved seats and methods of sitting are provided for meditation and other activities that urge a user to settle naturally into a proper alignment of their spine so that they can develop a natural sense of balance and related muscle memory that enables them to continue the posture when not using the seat of the present invention. Seats of the present invention include a supported portion that includes a sitting surface and a leg portion having a proximal end that may be connected to the supported portion. The leg portion further includes a distal end that acts as a pivot on a floor or other surface suitable for supporting the seat and user, thereby allowing the user to balance themselves around the pivot.

20 Claims, 7 Drawing Sheets

(56) References Cited

U.S. PATENT DOCUMENTS

| | | | | |
|---|---|---|---|---|
| 2012/0074753 | A1* | 3/2012 | Kalayjian | A47C 16/04 297/423.11 |
| 2012/0266471 | A1* | 10/2012 | Chao | B43L 7/00 33/478 |
| 2017/0218994 | A1* | 8/2017 | Chang | A47B 13/003 |

FOREIGN PATENT DOCUMENTS

| | | | | |
|---|---|---|---|---|
| CN | 107568896 | A * | 1/2018 | |
| CN | 207644780 | U * | 7/2018 | |
| DE | 29707882 | U1 * | 9/1998 | A47C 9/005 |
| DE | 202012006208 | U1 * | 9/2012 | A47C 4/02 |
| FR | 2917277 | A1 * | 12/2008 | A47C 3/029 |
| GB | 2379383 | A * | 3/2003 | A47C 9/005 |
| JP | 2011125666 | A * | 6/2011 | |
| JP | 5554860 | B1 * | 7/2014 | |
| JP | 3203330 | | 3/2016 | |

* cited by examiner

FIG. 4B
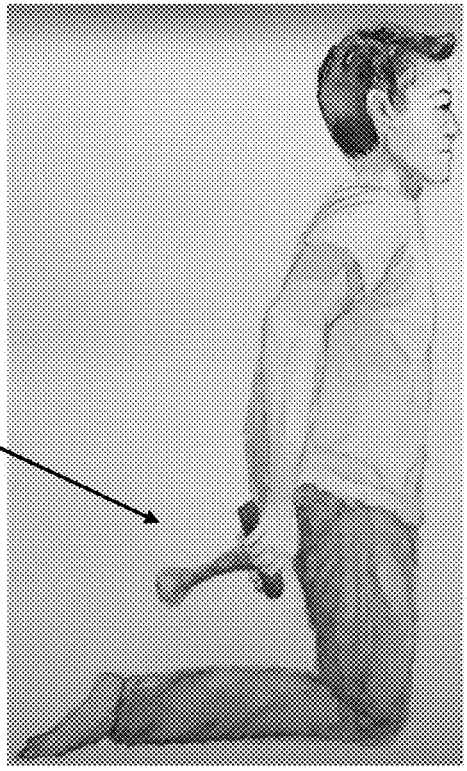
10
60
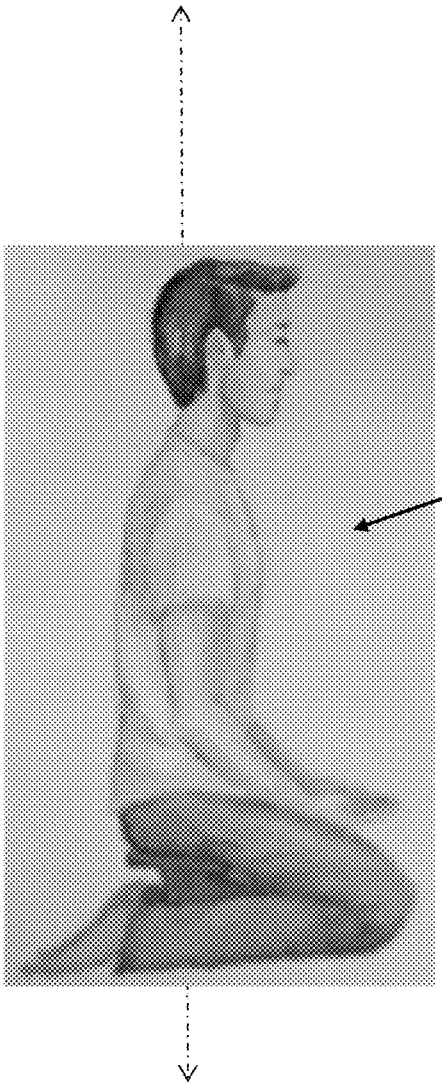
FIG. 4C

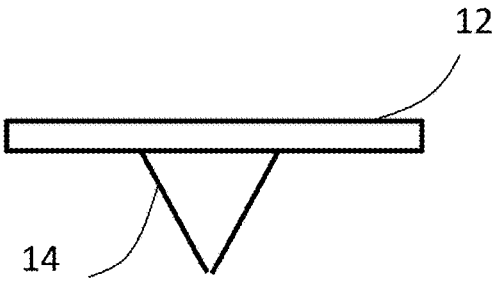
FIG. 5A
FIG. 5B
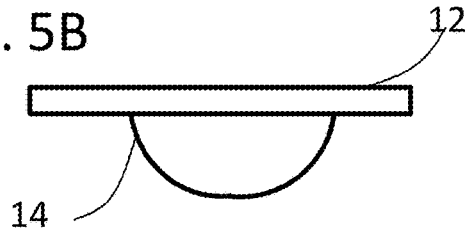
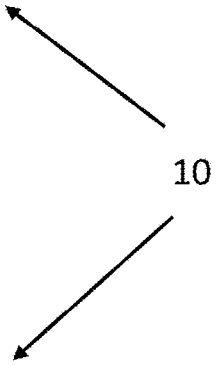
FIG. 5C
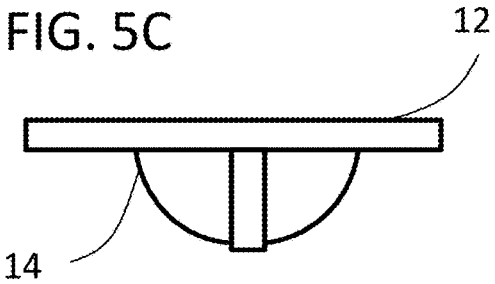
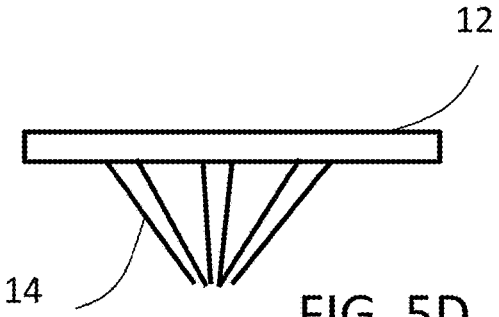
FIG. 5D

SEATS FOR IMPROVING POSTURE AND ALIGNMENT OF THE SPINE AND METHODS OF ACHIEVING THE SAME

CROSS-REFERENCE TO RELATED APPLICATIONS

This application claims the benefit of U.S. Provisional Application No. 62/420,754 filed Nov. 11, 2016 and is a continuation-in-part of U.S. patent application Ser. No. 15/080,884 filed Mar. 25, 2016, both of which are incorporated herein by reference in their entireties.

BACKGROUND OF THE INVENTION

Field of the Invention

The present invention relates to furniture and, more particularly, to improved seats.

Background Art

Many, if not most, seats, are not designed with posture in mind and as a result those seats do not support good posture, which can aggravate or result in a variety of physical maladies. Many of the seats that are designed for good posture tend to be rigid and force the spine into an unnatural alignment. Those seats tend to limit a user's range of movement, acting as a temporary crutch, that once removed leaves the user without the muscle memory needed to provide good posture.

As such, there is a continuing need for seats that serve to improve the posture of the user, while providing a comfortable sitting experience.

SUMMARY OF THE INVENTION

The present invention provides improved seats and sitting methods for meditation and other activities that reduce slouching and poor posture and urge a user to settle naturally into a proper alignment of their spine. The seats promote a natural sense of balance and related muscle memory that enables the user to maintain good posture even when they are not using the seat.

Seats of the present invention include a supported portion having a sitting surface and a leg portion having a proximal end that may be connected to the supported portion and a distal end that may be placed on a floor or other surface suitable for supporting the seat and the user. The distal end acts as a pivot when in contact with the supporting surface and about which the user balances themselves when using the seat of the present invention. The pivot may be configured in a variety of shapes, e.g., point-like, flat, curved, etc. and sizes to achieve the objective of the invention.

These and other features, aspects and advantages of the present invention will become better understood with reference to the following drawings, description and claims.

BRIEF DESCRIPTION OF THE DRAWINGS

FIG. 4A-C is a perspective view of exemplary embodiments of the present invention in use by a user.

FIGS. 5A-D are side view of exemplary embodiments of the present invention with various exemplary leg portion embodiments.

Figure 1:
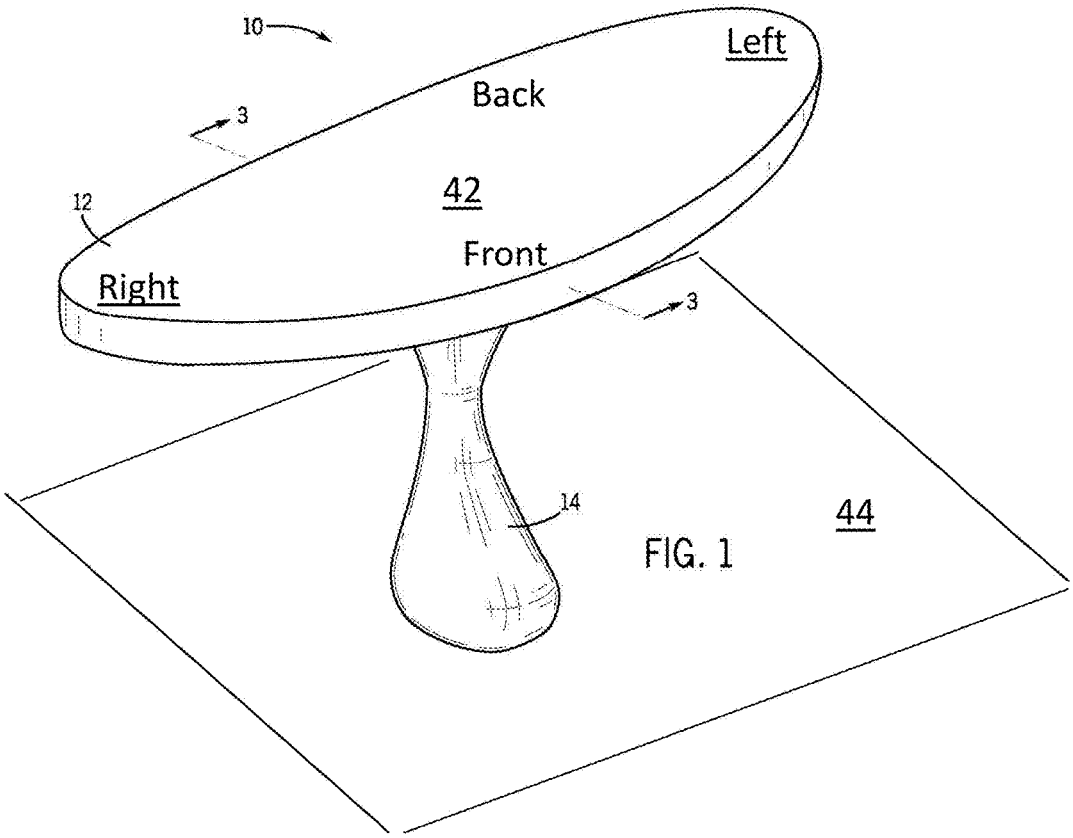
FIG. 1 is a perspective view of exemplary embodiments of the present invention.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

DETAILED DESCRIPTION OF THE INVENTION

FIG. 1 shows various embodiments of the present invention as a seat 10 having a supported, or seat, portion 12 supported by leg portion 14. The leg portion includes a proximal end 32 and a distal end 34 configured as a pivot in contact with a surface 44, e.g. floor or other structure, when the seat is in use. The distal end may be configured to enable the seat 10 to be free standing when not in use or not.

The supported portion 12 may further include a sitting surface 42 generally opposing a structural surface 30 where the leg portion 14 may be attached. The user of the seat 10 may generally use the sitting surface 42 to contact and support their body. The sitting surface 42 may generally include a front, back, left side, and right side relative to the leg portion 14. The seat portion 12 may be mounted perpendicular to the leg portion 14 or tilted at an angle front to back and/or left to right. The tilting of the supported portion 12 may be matched to the angle of a user of the seat 10. The tilting forward of the seat 10 also tends to put the pelvis in neutral alignment creating the conditions for neutral spinal alignment and encouraging good posture. The sitting surface 42 may assume any shape, contour, surface texture, and size as may be desired by the user.

For meditation and other kneeling seat uses, the sitting surface may be oval shaped with a width of 12-18 inches and front to back length of 6-12 inches. In addition, it may be desirable to mount the leg portion 14 at an acute angle (60-<90 degrees) relative to front of the seat portion 12 and an obtuse angle ((>90-120 degrees) relative to the back of the seated portion 12 conducive to supporting the user in the kneeling position. The tilt or angle of the sitting surface may be selected by the artisan to facilitate a comfortable knee angle as well as puts the pelvis in neutral alignment. However, the skilled artisan may tailor the dimensions and shape to their desired applications and kneeling preferences.

The seat 10 may be comprised of any material of sufficient strength to withstand the weight of the users. For example, solid wood may be a suitable material for seats 10. Hard plastic or rubberized materials may be more suitable for high volume, multiple user fitness facility usage scenarios. As noted below, different materials may be used in combination to provide different characteristics, such as using metal fasteners and plates in a leg assembly 100 to provide structural integrity. The sitting surface 42 may include padding or other material that is the same or different than the structural material used for the supported portion 12, as desired.

Figure 2:
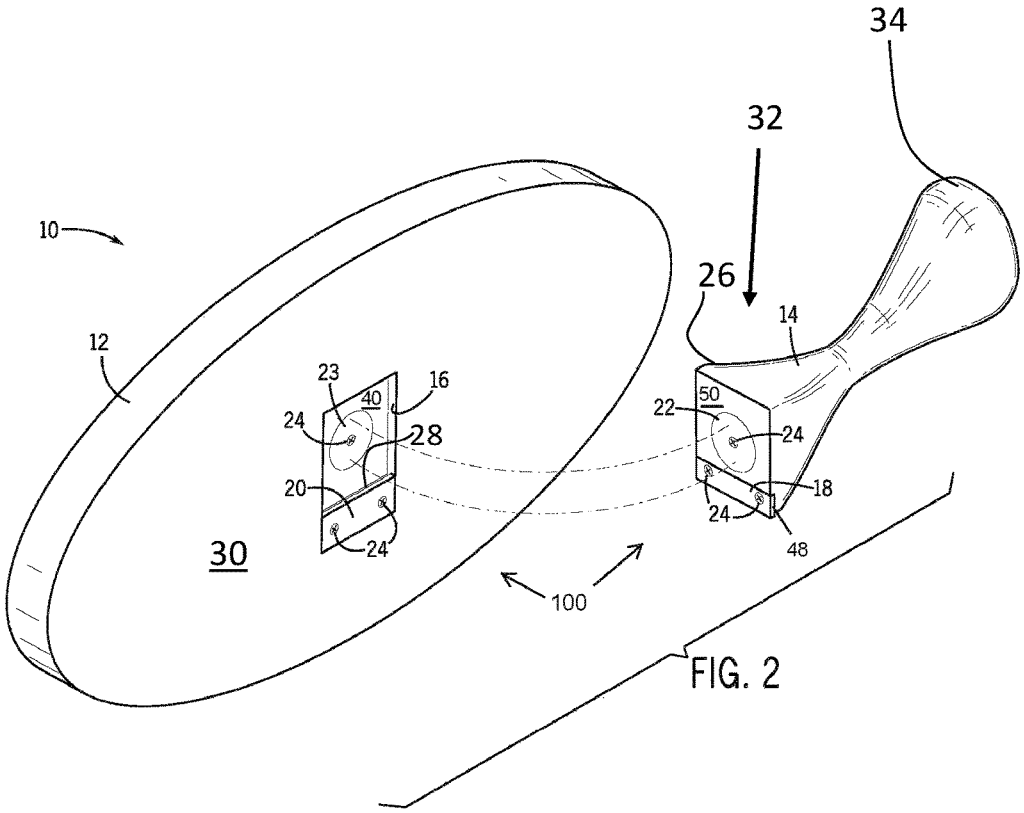
FIG. 2 is an exploded perspective view of exemplary embodiments of the present invention.

As shown in FIG. 2, the leg portion 14 may be removably attached to the supported portion 12 by the leg support assembly 100. The leg support assembly 100 may enable the seat 10 to be assembled into an operative configuration, as illustrated in FIG. 1, and disassembled into a storage configuration, as illustrated in FIG. 2.

It will be appreciated that with re-attachable leg embodiments, different size and designed leg portions may be used with one seat portion for aesthetic and functional purposes. Similarly, one leg portion may be used with multiple seat portions that share a common leg assembly structure.

The leg portion 14 may also be adjustable to vary the height of the supported portion 12, e.g., by telescoping, so that one seat may be used for multiple users and/or seating angles. For example, when implemented as kneeling stool, different size users may desire the sitting surface 42 at different heights or one user may want to vary the height of the sitting surface 42, and the commensurate angle that the knee is bent, depending upon the particular activity in which the user is engaged, such as meditation, working at a desk, eating, reading, relaxing, etc. and the conditions of their joints. Generally speaking, the length of the leg portion 14 for kneeling may generally range from 4 to 20 inches depending upon the size of the user and the desired knee angle.

Returning to FIGS. 1 and 2, the leg support assembly 100 may include a first mortise 16 communicating with a second mortise 28, both mortises 16, 28 may be recessed from the structural surface 30 of the supported portion 12, forming a shared mortise surface 40, which may be in the same or different planes for each mortise.

The leg support assembly 100 may include a first tenon 26 and a second tenon 48 provided near the proximal end 32 of the leg portion 14, forming a shared tenon surface 50, which may be in the same or different planes for each tenon. The first and second mortises 16, 28 are dimensioned and adapted to slidably receive the first and second tenons 26, 48, respectively. In use, the second tenon 48 may be partially inserted into the second mortise 28, and the leg portion 14 rotated until the second tenon 48 is fully inserted into the second mortise 28 and the first tenon 26 is inserted in the first mortise 16.

A first distance between the shared mortise surface 40 and the structural surface 30 may be greater than a second distance between the shared mortise surface 40 and a second boundary, so that while the first tenon 26 may normally slide into the first mortise 16, the second tenon 48 and second mortise 28 may be configured to require the second tenon 48 to engage the second mortise 28 at an engagement angle. Meaning, both tenons 26, 48 need to be oriented at the engagement angle (as measured relative to the longitudinal axis of the leg portion 14 to the longitudinal axis of the structural surface) when operatively engaging the two tenons and the two mortises simultaneously, preventing a perpendicular "normal" engagement. The engagement angle may be at least 15 degrees, but one of ordinary skill may design the relative sizes of the tenons, mortises, and engagement angles to support various types of seats as desired.

The second tenon 48 may extend along the shared tenon surface 50 so as to protrude beyond a periphery of the first tenon 26. In certain embodiments, the second tenon 48 may protrude beyond such periphery by about 3/16 of an inch.

Figure 3:
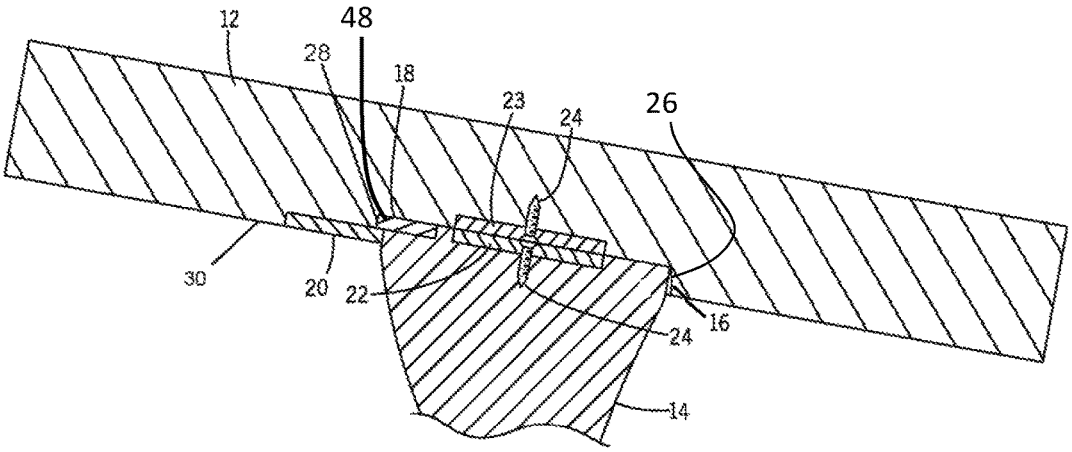
FIG. 3 is a cross-sectional view of exemplary embodiments of the present invention, taken along line 3-3 of FIG. 1.

In various embodiments, the second tenon 48 may include at least a portion of a latch plate 18. The latch plate 18 may be made of a metallic material, such as brass, as illustrated in FIG. 3. The supported portion 12 may include a complementary receiver plate 20. The receiver plate 20 may be made of similar metallic material, such as brass, as the latch plate 18. The receiver plate 20 may be flush with the structural surface 30 and extend to define the second boundary of the second mortise 28.

Brass is a desirable plate material as it is low in weight, corrosion resistant, and non-magnetic. In various embodiments, non-magnetic plates may be desirable, so as to not interfere with magnetic connections as described below. In other embodiments, it may be desirable to include magnetic plates depending upon the attachment mechanism.

Metallic latch and receiver plates 18 and 20 are typically much more durable than wood and hard plastic, which are typical materials used for the seat 10, so that the latch and receiver plates 18 and 20 securely and can withstand repeated, striking contact as the leg portion 14 is assembled and removed, and prolonged strong pressure from sitting without splintering or deforming.

A mortise magnet 23 and a cooperating tenon magnet 22 may be disposed flush along the shared mortise surface 40 and the shared tenon surface 50, respectively, so that when in the operative configuration, the mortise and tenon magnets 23, 22 are magnetically attracted to each other. Each magnet 23, 22 may be separately attached to their respective supported portion 12 and leg portion 14 by a fastener 24. As shown in FIG. 2, the magnetic material may be disposed in the first mortise 16 and the first tenon 26 to engage magnetically as the first tenon 26 is inserted into the first mortise 16.

The snug nesting of the second tenon 48 and the second mortise 28, wherein the shared mortise surface 40 and the receiver plate 20 sandwich the second tenon 48, is adapted to prevent displacement of the second tenon 48 in a direction generally perpendicular to the shared mortise surface 40. The magnets 23, 22 prevent all movement, including pivotal movement about the periphery of the first tenon 26.

A method of using the present invention may include the following. The leg support assembly 100 disclosed above is provided on the seat 10. From the storage configuration to the operative configuration, a user manipulates the leg portion 14 so that the engagement angle relative to the supported portion 12 is sufficient for the second tenon 48 to slide into the second mortise 28 so as to snugly nest therein, and then the user further manipulates the leg portion 14 so the magnets 23, 22 magnetically engage as the first tenon 26 engages the first mortise 16, forming the operative configuration. From the operative to the storage configuration, the user must pivot the leg portion 14 along a distal edge 52 of the latch plate 18 so the user may disengage the magnets 23, 22 and withdraw the second tenon 48 from the second mortise 28.

As illustrated in FIG. 1, the following advantages of the present invention include: the seat/supported portion 12 may be designed with the latch plate 18 located in the "rear" of the seat to keep the single leg portion 14 from disengaging when there is pressure exerted from the front. (This is the pressure exerted when someone is kneeling with the seat under their rear in the correct position.) Pressure from the back causes the leg portion 14 to disengage instantly when breaking down the seat into the storage configuration to stow it away. (This is the pressure exerted when someone uses their hand to remove the leg.).

Furthermore, the ability of a user to adjust their position (pivot on the ball of the leg) to find comfort, perfect balance and a perfect meditation posture for all body types is afforded by the one-legged seat.

FIGS. 1 and 2 show various embodiments of the seat 10 in which the leg portion 14 having the proximal end 32 connecting to the supported portion 12 and a distal end 34 that has a shape adapted to provide a pivot, e.g., a bulbous pivot end, about which a user sitting on the sitting surface 42 will tip when their body and thus spine is not in proper alignment. As a result, the pivot end 34 facilitates the user in settling naturally in a proper alignment of their spine when they sit on the sitting surface 42 as their body balances on the pivot. The balancing required by the seat 10 also encourages and even necessitates a physical and mental alertness which are essential foundations of proper meditation practice.

It will be appreciated that the geometric shape and physical dimensions of the pivot may be determined by persons of ordinary skill. For example, the leg portion 14 in FIGS. 1 and 2 may have the pivot dimensioned to be free standing when the seat 10 is not in use, but nonetheless provide the pivot function that requires the user to balance themselves around the pivot when the seat 10 is in use. In other implementations, the leg portion 14 may include one or more leg members that do not enable the seat 10 to be free standing when not in use, but provide the pivot function when use. The portion of the distal end contacting the surface 44 may be flat, rounded, pointed, etc., as may be desired.

Figure 4A:
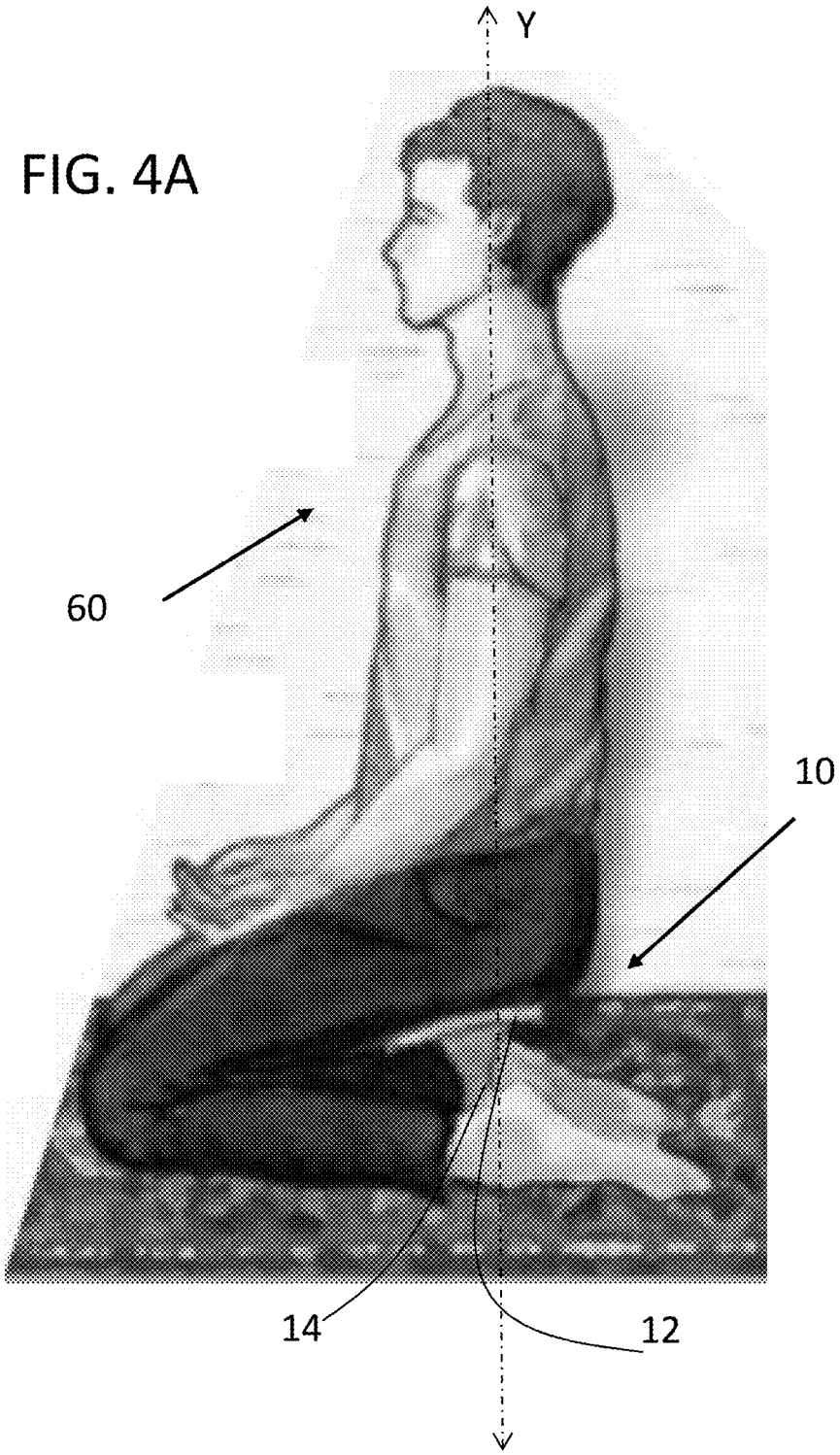

FIG. 4A illustrates a method using a seat embodying the present invention in which a user 60 may utilize the seat 10 by kneeling, with their right and left legs extended backward. The seat 10 is placed on the surface between the left leg and right leg with one leg on each side of the leg portion 14. The user 60 lowers their buttocks until reaching a seated position on the sitting surface 42 of the supported portion 12. The user 60 then adjusts their seated position until the user 60 is balanced around the pivot, generally by equally distributing the force or pressure applied by their body weight to the sitting surface 42 around the pivot.

Alternatively, as shown in FIGS. 4B and 4C, the user 60 may hold the seat 10 in proximity to, or contacting, their buttocks while in the kneeling position. The user 60 will continue to recline until the distal end 34 of the seat 10 contacts the supporting surface. If the user 60 is not comfortable with holding the seat while reclining, the user 60 may have another party hold the seat 10 until the user is in the seated position with the distal end contacting the surface and can begin to balance themselves on the seat 10 about the pivot.

Experiencing the tipping point effect, the user will naturally settle into a proper vertical alignment of their spine so as to maintain their presence on the sitting surface 42. Balancing is generally effectuated by a user equally, or substantially equally, distributing the force or pressure of their body weight applied to the sitting surface 42 relative to the pivot. In other words, a substantially equal force may be applied to the front, back, left side, and right side of the sitting surface to balance the seat around the pivot.

As further shown in FIG. 4A, the pivot generally creates a vertical, or substantially vertical, axis Y about which the user 60 will balance when using the seat 10. It will be appreciated that the leg portion 14 does not have to produce a pivot that precisely results in a vertical axis balance point. However, it will be appreciated that offsetting the pivot from vertical will tend to increase the rotational effect of gravity on the user to be offset by the user of the seat 10. In various embodiments, it may be desirable to produce a pivot that is off vertical to facilitate various use scenarios, such as a forward lean when working, eating, reading, relaxing, or otherwise.

It will be appreciated by one of ordinary skill in the art that the pivot provided on the leg portion 14 may be implemented in a wide variety of dimensions, contours, and shapes for various aesthetic and artistic reasons, all of which are contemplated by the invention. For example, the pivot may be dimensionally quite large or quite small, so long as it provides a pivot for the user to balance and distribute their weight. The shape of the pivot may be variety from circular and oval shapes to multi-pointed star shapes and arbitrary shapes, etc. as desired and the portion of the pivot contacting the surface 44 may be flat, curved, pointed, bumped, etc., so long as it serves the pivot function.

FIGS. 5A-D are side views of exemplary embodiments of the present invention with various exemplary leg portion 14 embodiments. FIG. 5A shows the seat 10 having the leg portion 14 with a wide proximal end 32 tapering to sharp pivot point at the distal end 34 in contact with the surface 44. FIG. 5B shows the seat 10 having the leg portion 14 with a wide proximal end with a smooth curve to the pivot point. FIG. 5C shows the seat 10 with the leg portion 14 that may employ the same or different geometric shapes in two or more directions that approach a single pivot point in operation.

FIG. 5D shows the seat 10 having the leg portion 14 that includes a plurality of separate legs, or leg members, that may or may be connected separately to the supported portion 12 that form the pivot when a user sits on the seat 10. The plurality of separate leg members may be independent or interconnected and may be rigid or compliant to achieve the desired pivot when in use. For example, multiple leg members may be employed to enable the seat to stand when not in use or to provide additional structural integrity, but some of the legs may be compliant when in use to allow the user to balance the supported portion 12 around the pivot upon application of a substantially equal force above a threshold force. One of skill in the art will appreciate that many other leg portion designs may be implemented to achieve various seating and ornamental objectives.

Figure 6A:
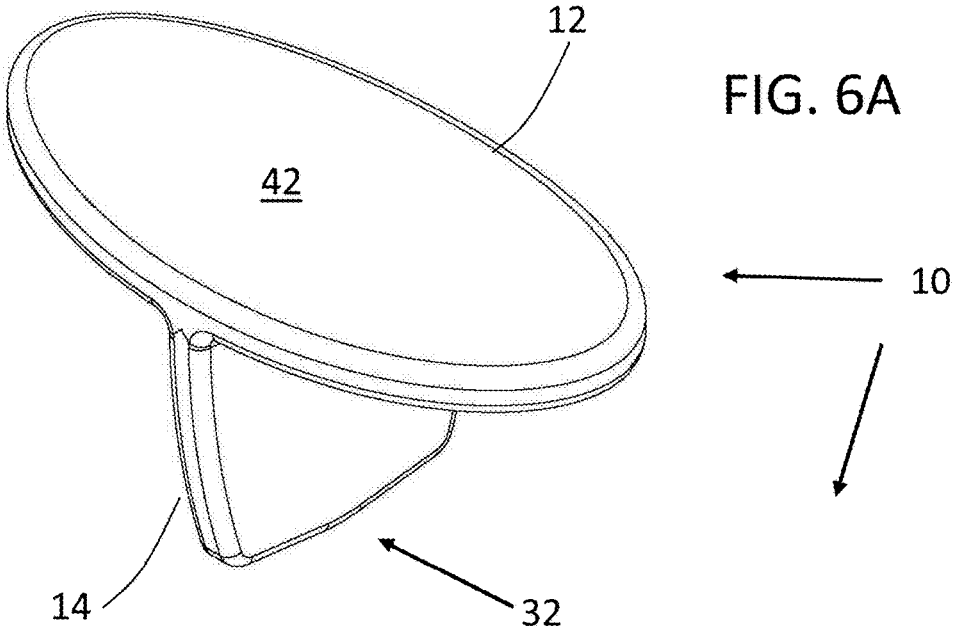
FIGS. 6A-B are top and bottom perspective views of exemplary embodiments of the present invention.
Figure 6B:
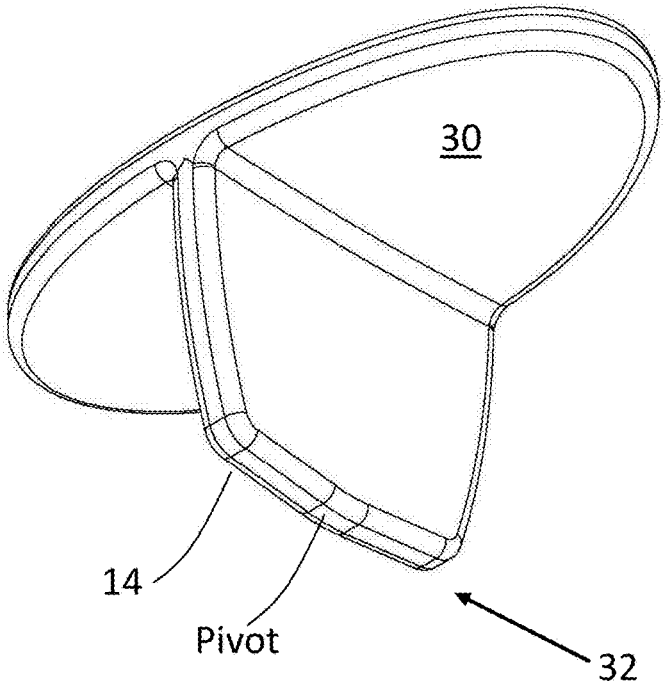

FIG. 6A-B are top and bottom perspective views, respectively, of exemplary embodiments of the present invention with the leg portion 14 extending substantially between the front and back of the supported portion 12. In these and other embodiments, the distal end 34 may serve as the pivot in 360 degrees or some fraction thereof, such as a front to back, side to side, etc. The supported portion 12 and leg portion 14 may be modified in dimension and design by one of ordinary skill to provide various aesthetic appearances, such as including cut outs and curved contours.

The foregoing disclosure provides examples, illustrations and descriptions of the present invention, but is not intended to be exhaustive or to limit the implementations to the precise form disclosed. Modifications and variations are possible in light of the above disclosure or may be acquired from practice of the implementations. These and other variations and modifications of the present invention are possible and contemplated, and it is intended that the foregoing specification and the following claims cover such modifications and variations.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A single leg seat, comprising:

a supported portion having a sitting surface and a structural surface; and a single leg portion to support the supported portion, the leg portion having a proximal end and distal end, the proximal end connecting to the supported portion, the distal end including a pivot about which the supported portion is balanced, and where the supported portion includes a first mortise and a second mortise in the structural surface, the first and second mortises having a recessed shared mortise surface, the first mortise extending at least perpendicular to the structural surface, and the second mortise extending in a different direction than the first mortise, and the shared mortise surface including a mortise magnet; and the single leg portion having a first tenon and a second tenon having a shared tenon surface, the first tenon cooperatively received by the first mortise when the second tenon is cooperatively received by the second mortise, the shared tenon surface including a tenon magnet positioned to magnetically engage with the mortise magnet when the first tenon is received by the first mortise and the second tenon is received by the second mortise.

2. The seat of claim 1, where the pivot defines a vertical axis relative to the supported portion about which the seat is balanced.

3. The seat of claim 1, where the seat has a front and a back portion and an axis is defined by the pivot tilting from back to front.

4. The seat of claim 1, where the first mortise extends generally perpendicular to the structural surface; and the second mortise extends generally parallel to the structural surface from the first mortise.

5. A single leg kneeling seat, comprising:

a supported portion having a sitting surface, a structural surface, a front, a back, a left side, and a right side; and a single leg portion to support the supported portion, the leg portion having a proximal end and distal end, the proximal end connecting to the supported portion, the distal end including a pivot about which the supported portion is balanced, and wherein the seat is free standing on the distal end, the leg portion having a length ranging from three to twelve inches, the front, the back, the left side, and the right side of the supported portion being defined relative to the leg portion, the leg portion attaching to the supported portion at an acute angle relative to the front and an obtuse angle relative to the back, and where the supported portion includes a first mortise and a second mortise in the structural surface, the first and second mortises having a recessed shared mortise surface, the first mortise extending at least perpendicular to the structure surface, and the second mortise extending in a different direction than the first mortise;

the recessed shared mortise surface including a mortise magnet; and the single leg portion having a first tenon and a second tenon having a shared tenon surface, the first tenon cooperatively received by the first mortise when the second tenon is cooperatively received by the second mortise, the shared tenon surface including a tenon magnet positioned to magnetically engage with the mortise magnet when the first tenon is received by the first mortise and the second tenon is received by the second mortise.

6. The kneeling seat of claim 5, where the distal end includes a bulbous pivot end.

7. The kneeling seat of claim 5, where a substantially equal force is applied to the front, back, left side, and right side of the sitting surface to balance the seat on the pivot.

8. The single leg kneeling seat of claim 5, where the pivot defines a vertical axis relative to the supported portion about which the seat is balanced.

9. The single leg kneeling seat of claim 5, where the pivot defines a vertical plane relative to the supported portion about which the seat is balanced.

10. The single leg kneeling seat of claim 5, where the seat has a front and a back portion and an axis is defined by the pivot tilting from back to front.

11. The single leg kneeling seat of claim 5, where the first tenon and first mortise extend substantially perpendicular to the structural surface and limit motion of the leg portion parallel to the structural surface; and the second tenon and second mortise extend substantially parallel to the structural surface and limit motion of the leg portion perpendicular to the structural surface.

12. The single leg kneeling seat of claim 5, where the supported portion includes a front and back where pressure exerted on the front of the sitting surface does not disengage the second tenon from the second mortise, and pressure exerted on the back of the sitting surface disengages the second tenon from the second mortise, the first tenon from the first mortise and the tenon magnet from the mortise magnet.

13. The seat of claim 5, where the supporting portion is comprised of wood, the second mortise has at least one surface defined by a receiver plate, and the second tenon includes a latch plate, wherein the receiver plate and the latch plate are comprised of metal.

14. The kneeling seat of claim 5, where
the sitting surface is oval-shaped.

15. The kneeling seat of claim 14, where
the sitting surface is at least twelve inches long spanning the left side to the right side.

16. The kneeling seat of claim 14, where
the sitting surface is less than eight inches front to back.

17. A method, comprising:
providing a single leg seat assembly including
a supported portion having a sitting surface and a structural surface,
the supported portion includes a first mortise and a second mortise in the structural surface,
the first and second mortises having a recessed shared mortise surface and recessed in different directions;
the shared mortise surface including a mortise magnet, and
a single leg portion to support the supported portion,
the leg portion having a proximal end and distal end,
the proximal end connecting to the supported portion, and including
a first tenon and a second tenon having a shared tenon surface,
the first tenon to be cooperatively received by the first mortise when the second tenon is cooperatively received by the second mortise,
the shared tenon surface including a tenon magnet positioned to magnetically engage with the mortise magnet when the first tenon is received by the first mortise and the second tenon is received by the second mortise,
the distal end including a pivot about which the supported portion is balanced;
inserting the second tenon into the second mortise; and
inserting the first tenon into the first mortise to engage the tenon magnet with the mortise magnet.

18. The method of claim 17, further comprising
placing the seat with the distal of the leg portion contacting the floor; and,
sitting on the seat in a kneeling position.

19. The method of claim 18, further comprising balancing around the pivot while sitting of the seat.

20. The method of claim 17, further comprising
applying pressure to at least one of the leg and the seat portion to disengage the tenon magnet from the mortise magnet;
removing the first tenon from the first mortise; and
removing the second tenon from the second mortise.

* * * * *